US006415950B1

(12) United States Patent
Robrechts

(10) Patent No.: US 6,415,950 B1
(45) Date of Patent: Jul. 9, 2002

(54) DISTRIBUTION INSTALLATION FOR PACKETS

(75) Inventor: Jozef Robrechts, Rijkevorsel (BE)

(73) Assignee: New Distribution Systems N.V., Geel (BE)

( * ) Notice: Subject to any disclaimer, the term of this patent is extended or adjusted under 35 U.S.C. 154(b) by 0 days.

(21) Appl. No.: 09/446,245

(22) PCT Filed: Jun. 16, 1998

(86) PCT No.: PCT/BE98/00091

§ 371 (c)(1),
(2), (4) Date: Apr. 19, 2000

(87) PCT Pub. No.: WO98/58804

PCT Pub. Date: Dec. 30, 1998

(30) Foreign Application Priority Data

Jun. 19, 1997 (BE) ..... 9700528

(51) Int. Cl.[7] ..... G07F 11/00

(52) U.S. Cl. ..... 221/85; 221/87; 221/124; 221/129; 221/130; 221/131; 221/133

(58) Field of Search ..... 221/85, 87, 123, 221/124, 126, 129, 130, 131, 133; 194/302, 344, 346; 232/7, 9, 12

(56) References Cited

U.S. PATENT DOCUMENTS 3,130,859 A * 4/1964 Vermeer
3,916,922 A * 11/1975 Prumm
4,108,333 A * 8/1978 Falk et al. ..... 221/13
4,171,752 A * 10/1979 Pertinen ..... 221/84
4,347,924 A * 9/1982 Hayashi et al.
4,494,675 A * 1/1985 Stutsman ..... 221/13
4,674,618 A * 6/1987 Eglise et al. ..... 194/210
4,687,119 A * 8/1987 Juillet ..... 221/101
5,494,146 A * 2/1996 Kurosawa et al. ..... 194/317
5,496,212 A * 3/1996 Meyer-Weingartner et al. .. 194/346 X
5,579,886 A * 12/1996 Ishida et al. ..... 194/202

FOREIGN PATENT DOCUMENTS

| | | |
|---|---|---|
| DE | 1474748 | * 5/1969 |
| EP | 0 243 268 | * 10/1987 |
| FR | 1416734 | * 9/1965 |
| WO | WO 97/08667 | * 3/1997 |

* cited by examiner

*Primary Examiner*—David H. Bollinger
(74) *Attorney, Agent, or Firm*—Browdy and Neimark, P.L.L.C.

(57) ABSTRACT

The invention concerns a distribution installation for packets with an operating device (1) and compartments (4) located beside and/or above one another in which the packets (3) to be selected can be arranged, in which transport means (9) controlled by the said device (1) are provided which enable a selected packet (3) to be transferred from the exit (8) of a particular compartment (4) to be dispensing hatch (6), and in certain compartments (4) a conveyor belt (7) is mounted which is directly of indirectly controlled from the operating device (1) and which enables the packets (3) concerned to be brought one by one to the exit (8) of the compartment (4) as far as the said transport means (9).

11 Claims, 4 Drawing Sheets

DISTRIBUTION INSTALLATION FOR PACKETS

CROSS REFERENCE TO RELATED APPLICATION

The present application is the national stage under 35 U.S.C. 371 of PCT/BE98/00091, filed Jun. 16, 1998.

BACKGROUND OF THE INVENTION

1. Technical Field of the Invention

The invention concerns a distribution installation for packets, with an operating device and compartments beside and/or above one another in which the packets to be dispensed, ordered or selected can be arranged, where by means of the said device, controllable transport means are provided that enable an ordered or selected packet to be transferred from the exit of a specific compartment to a dispensing hatch.

2. Prior Art

In most traditional distribution installations of this type, the packets are arranged in parallel rows behind one another in the said compartments. When a particular packet is selected from one of the compartments and go has to be transferred to the dispensing hatch, this is done by a pusher, located bend the last packet in the said compartment, pressing against the said packet and displacing it over a distance corresponding to that occupied by the said packet, so that the first packet in the row is pushed out of the compartment in order for it to be brought by the said transport means to the dispensing hatch.

Depending on the form and nature of these packets, various problems can arise in this way.

If for example the packets can be deformed relatively easily, e.g. bags with loose blocks of candy or with granular products, or which are bar or flat shaped so that they can easily slide over one another, there is a risk that when pressing against the last packet by means of the pusher, some of them can slide over one another or be compressed, so that several packets arrive at the dispensing hatch at the same time.

OBJECT AND SUMMARY OF THE INVENTION

The invention has as its main aim to offer a major improvement which can be applied to such installations in a very simple way, so as to solve the above-mentioned problem, totally regardless of the nature and form of the packets to be moved to the dispensing hatch.

For this purpose, according to the invention, a conveyor belt is mounted in the compartments concerned being directly or indirectly controlled from the operating device, and permitting the packets to be delivered one by one to the above-mentioned transport means.

According to the invention, the conveyor belt more specifically forms the floor of the compartment concerned, on which the packets can be placed.

In a particular embodiment of the invention, the said compartments are separated fir one another by partitions in which a drive mechanism is provided for the conveyor belt lying against one of its sides.

In a more specific embodiment of the invention, the said drive mechanism comprises a cable or chain transmission movable in steps, which can be moved parallel to the conveyor belt, where between the said transmission and the conveyor belt an engagement dog is fixed to the conveyor belts permitting the same movement to be imposed on the latter as on the said transmission, in a synchronous maimer.

In the above-mentioned distribution installations, the said engagement dog is formed by the pusher which, according to the invention, is fixed-mounted on the conveyor belt, with the latter in this case moving on freely-rotating rollers.

The invention further concerns a distribution installation in which the operating device comprises an automatic cashier, and in which the compartments for the packets to be ordered or selected may or may not be equipped with the above-mentioned conveyor belt.

In most distribution installations with an automatic cashier, there is the problem that the recipient for the inserted coins has to be emptied very frequently, while the one destined for giving change in turn has to be filled very frequently.

In intensively-used distribution installations, this can be a very time-consuming operation.

The invention is aimed at among other things dealing with this major disadvantage, in a relatively simple way, by proposing a distribution installation for packets in which the automatic cashier is equipped with a receiver for inserted coins which cooperates with a coin tester, where the said receiver connects, on the one hand, with a hopper divided into various compartments, and, on the other hand, with a return ay for coins not accepted by the coin tester, where the said coin tester is provided with means for guiding the accepted coins separately, type by type, to the above-mentioned various compartments of the hopper, where furthermore control means are provided which enable the total amount of the coins and of any banknotes, which may, be introduced separately into the automatic cashier via a banknote reader, to be compared with a credit amount corresponding to the value of the packets ordered, and to re=un any remaining balance via the hopper to a hatch.

Finally, the invention concerns an important improvement to the dispensing hatch for a distribution installation for packets with an operating device and compartments located beside and/or above one another, in which the packets to be selected can be arranged, where by means of the said device controllable transport means are provided which enable a selected packet to be transferred from one of the said compartments to a collection tray.

This improvement is characterised by the fact that means are provided which permit a selected packet to be transferred from the collection tray to the dispensing hatch.

In a preferred embodiment according to the invention, a flexible belt is provided between two opposite edges of the collection tray, which in a first position defines a hollow space in the collection tray, into which a selected packet arrives, and in a second position is tightened to form a sloping surface between the said two edges, in such a way that the corresponding packet is automatically led into the dispensing hatch.

BRIEF DESCRIPTION OF THE DRAWINGS

Other features and advantages of the invention will be apparent from the following description of a particular embodiment of a distribution installation according to the invention; his description is given by way of example only, and does not affect the scope of the invention; the reference figures used below refer to the attached drawings.

In these different figures, the same reference. figures relate to the same parts.

DETAILED DESCRIPTION OF THE PREFERRED EMBODIMENT(S) OF THE INVENTION

Figure 1:
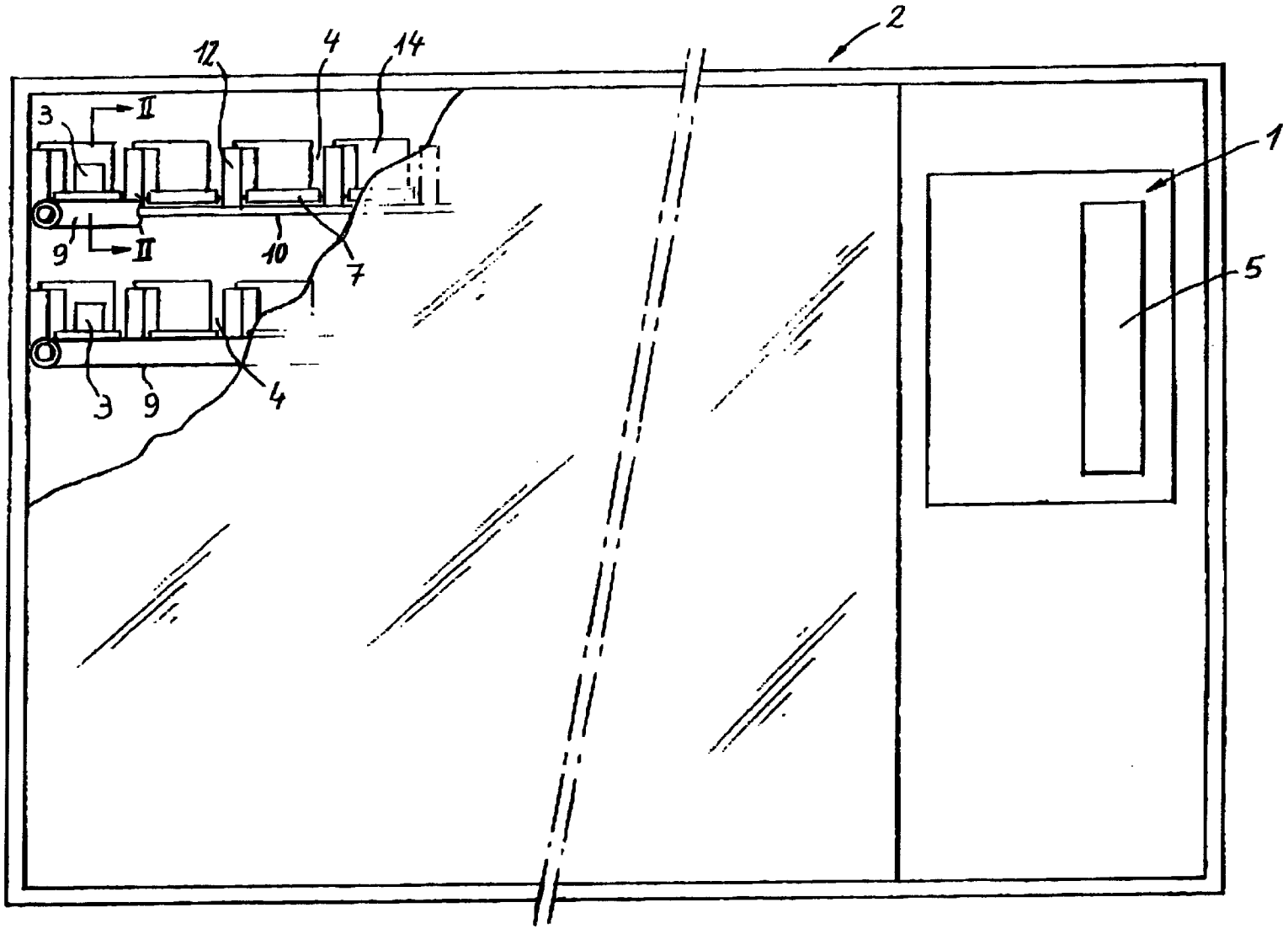
FIG. 1 is a schematic front view, with a partial cross-section of a particular embodiment of a distribution installation, according to the invention, for packets.

The invention concerns a distribution installation for packets with an operating device 1 and a display case 2 in which the packets 3 to be dispensed, ordered or selected can be arranged beside and above one another in compartments 4. Such an installation is generally referred to as an automatic shop.

The said installation enables the customer to select from among the packets 3 displayed in the display case 2, by means of e.g. a keyboard 1*a* and a screen 1*b* in the operating device 1, which comprises an automatic cashier 5 into which customers can introduce the required money for the selected packets 3. Once payment has been made, the said selected packets are then transferred automatically to a dispensing hatch 6 where the customer can take possession of the said packets. This is in fact a self-service shop which only differs from a conventional self-service shop in that, according to the invention, the selected products are automatically delivered to a dispensing hatch, and payment is made, without any member of personnel being required.

All that is necessary is for the compartments 4 of the display case 2 to be sufficiently stocked at all times with packets 3.

Figure 2:
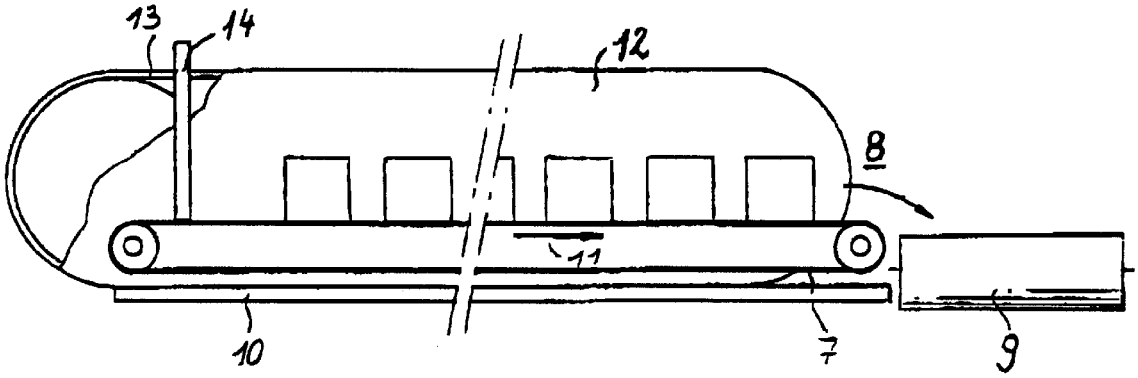
FIG. 2 shows a cross-section along the line II—II in FIG. 1, to a greater scale.

An important characteristic of the invention is that at least in certain compartments, in which for example deformable packets are accommodated, a conveyor belt 7 is mounted which is directly or indirectly controlled by the operating device 1, and which permits the corresponding packets 3 to be led one by one to the exit 8 of the compartment 4 and from there to transport means, which permit an ordered or selected packet 3 to be transferred from the said exit 8 to the dispensing hatch 6. The said transport means can be very varied in nature, and can consist of e.g. a robot which collects the packets presented at the exit 8 in a basket and brings them to the dispensing hatch 6, or of another conveyor belt, such as the conveyor belt 9 shown in FIGS. 1 and 2, which is located at the same level as the conveyor belt 7 and moves perpendicular to it along the exit 8 of the various compartments 4 to the dispensing hatch 6. In the embodiment shown in the attached drawings, the conveyor belt 7 extends along the bottom 10 of the compartments 4, so that the packets 3 can be placed on top of the conveyor belt 7. In this way, when the conveyor belt 7 moves in the direction of the exit 8 of a particular compartment 4, as indicated by arrow 11, no more pressure is exerted on this packet by a so-called pusher, so that during their corresponding displacement the packets maintain their relative position with regard to one another.

Consequently, it is sufficient to assign the packets a position one after another on the conveyor belt 7 in the direction of arrow 11, where the dimensions of the said position in the longitudinal direction of the conveyor belt 7 is always the same. Whenever a certain packet has to be taken from the exit of a particular compartment, it is therefore sufficient for the conveyor belt 7 to be moved over a constant distance, corresponding to the said dimension, so that one packet and one only is always dispensed from the compartment under consideration.

The various compartments 4 are separated from each other by partitions 12 in which there is a drive mechanism 13 for the conveyor belt 7 lying against one of the sides.

More specifically, in the particular embodiment shown in the accompanying drawings, the drive mechanism comprises a cable transmission 13 which moves in steps parallel to the conveyor belt 7, and which makes provision for an engagement dog 14 to be fixed to the conveyor belt 7. In this way, the said engagement dog 14 enables the same movement to be imposed on the conveyor belt 7 as undergone by the cable transmission 13, in a synchronous manner.

According to the invention, the conveyor belt 7 can be removably-mounted in the compartments 4 of distribution installations which themselves are known, without the said installations having to undergo practically any modifications. In principle, the pusher in existing installations is set in its rearmost position on the conveyor belt 7, in such a way that when the said pusher is driven, the conveyor belt 7 automatically moves, and thus moves all the packets located on it, towards the exit 8, without the said packets having to be subjected to pressure in the direction of arrow 11. In this case, the pusher which itself is known forms the engagement dog 14.

Another important component of the distribution installation according to the invention concerns the automatic cashier 5, and may or may not be applied along with the driven conveyor belt 7 in the compartments 4.

Figure 3:
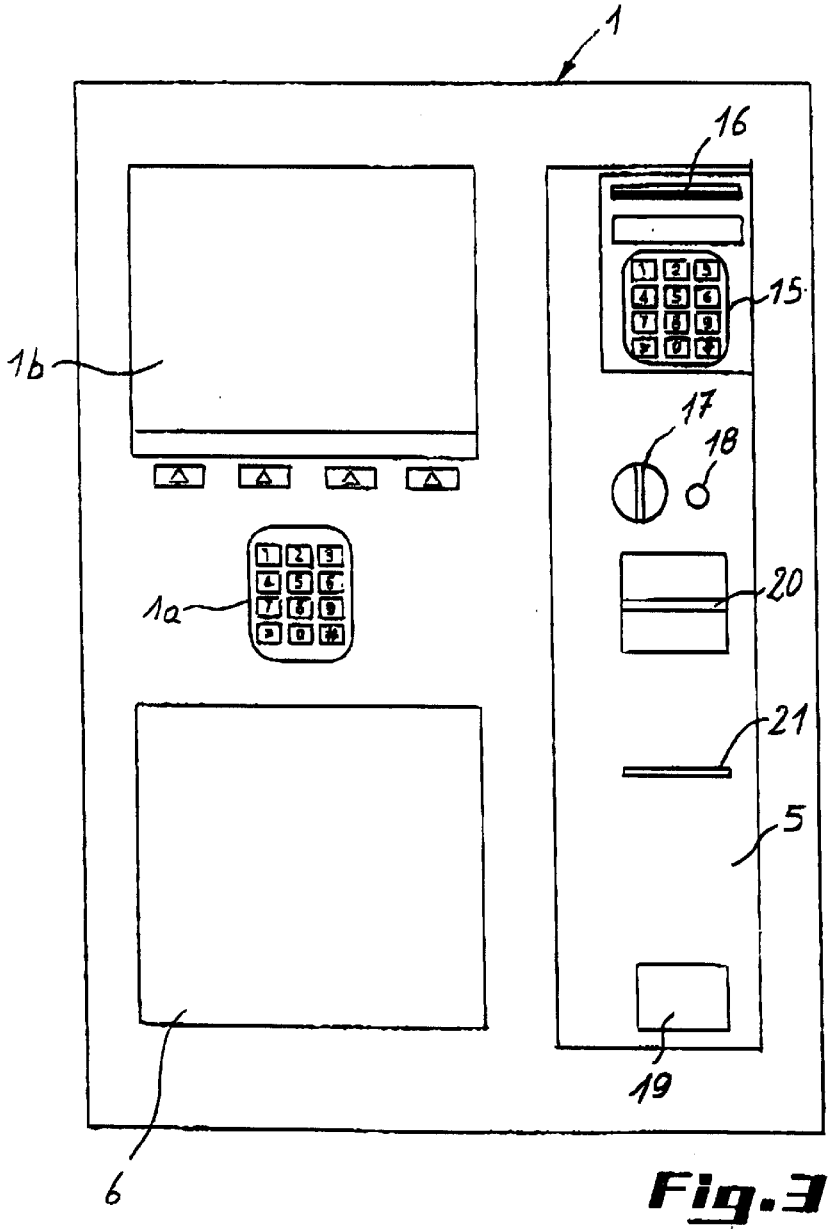
FIG. 3, also to a greater scale, shows a front view of an important component of this particular embodiment of a distribution installation according to the invention.

FIG. 3 is a front view of the operating device I into which the automatic cashier 5 is built.

Figure 4:
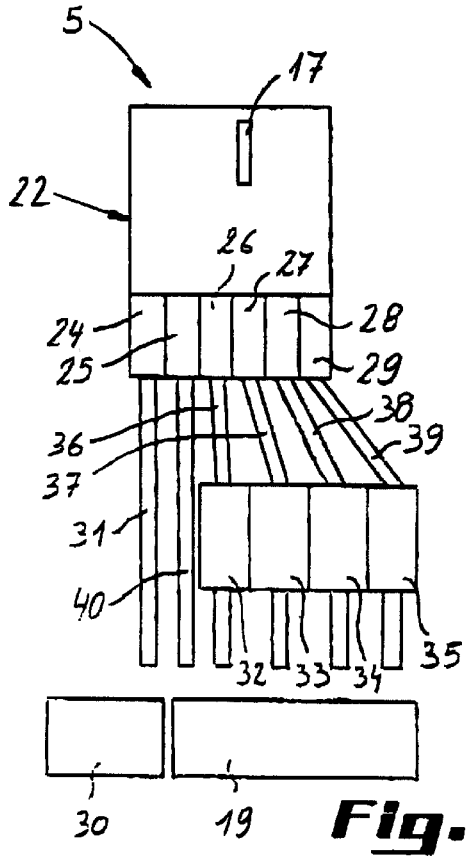
FIG. 4. is. a schematic detail view of certain parts of the component according to FIG. 3.

FIG. 4 is a front view of the said automatic cashier, with certain components of the automatic cashier concerned being shown schematically in greater detail.

Figure 5:
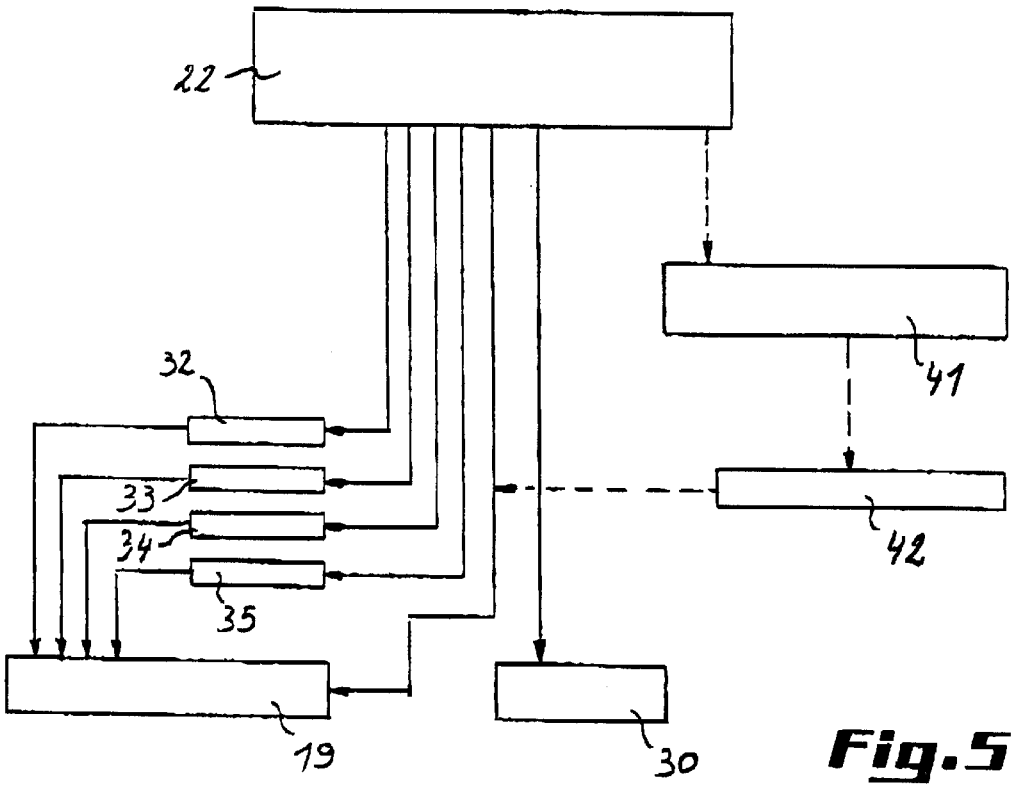
FIG. 5 is a block diagram of the component shown in FIG. 3.

FIG. 5 is a block diagram which illustrates the operation of the automatic cashier.

The automatic cashier 5 permits various methods of payment, making it possible to carry out payments with payment cards, coins or banknotes.

In FIG. 3, a keyboard 15 is shown at the top right, with above it a slot 16 for a payment card. Underneath the said keyboard 15 is an insertion slot for coins 17, with beside it a return knob 18 which enables the purchase to be concluded and the excess amount paid to be recovered via a return hatch 19.

Between the insertion slot 17 and the return hatch 19 is another slot 20 for inserting banknotes and a slot 21 for the ticket with the receipt for the goods purchased.

As shown in FIG. 4, the insertion slot 17 connects to a coin collector 22 with a built-in coin tester (not shown) which enables rejected coins to be led directly to the return hatch 19 through a channel 23 provided for this purpose, and to identify the various types of coins and to accommodate them in the separate sorting compartments 24 to 27 provided in the collector 22.

If no separate sorting compartment is provided for particular types of coins, the latter end up in the same sorting compartment 24, and are led to a so-called collective cashbox 30 via a tube-shaped channel 31 such as also shown schematically in FIG. 4.

This figure shows an automatic cashier 5 with a collector 22 in which four sorting compartments 26 to 29 are provided for four types of coin which can be collected separately in the said collector. According to the invention, each of these sorting compartments 26 to 29 connects directly to a corresponding hopper 32 to 35 via guide channels 36 to 39 provided for this purpose.

Finally, in the collector 22 there is also a separate sorting compartment 25 for the rejected coins, which are led directly via a channel 40 to the return hatch 19.

Further, control means which in themselves are known are provided, permitting the total amount received in coins and in any banknotes to be compared with the credit amount corresponding to the value of the packets ordered, and any remaining balance to be transferred to the return hatch 19 via the above-mentioned hoppers.

The said means for enabling the amount paid to be compared with a credit amount are shown schematically in FIG. 5 by the rectangle 41. These means are controlled from the collector 22, which has a calculation unit (not shown) built into it. If the said calculation yields a positive remaining balance, men a command is given by a control unit 42 to the hoppers for this balance to be delivered to the return hatch 19. This process automatically ensures the minimum number of coins is used for repaying the said balance.

Thanks to the fact that the hoppers are directly fed by the incoming coins, the said hoppers need to be topped up much less frequently than in existing automatic cashiers, in which such a connection does not exist, so that it is necessary for all coins to be transferred from the collector 22 to the collective cashbox 30. The latter therefore needs to be frequently emptied, and the coins from it have to be manually transferred to the different hoppers according to type.

Finally, the invention also concerns a significant improvement in the dispensing hatch 6.

In most existing installations of this type, the dispensing hatch is formed by a collection tray by means of which the packet from the compartments in which it is stored is presented. In such a case, the customer himself has to take the ordered packet directly out of the collection tray by hand. This is not entirely risk-free, since in this way the hand can come in contact with certain moving parts of the transport means of the distribution installation.

According to the invention this problem is obviated by providing means which enable a selected packet 3 to be transferred separately from a collection tray 43 to a separate dispensing hatch 6 located completely outside the danger zone.

A specific embodiment of these means is illustrated in the accompanying drawings FIGS. 6 to 10 representing a schematic cross-section at the point of the hatch 6 in the different stages of transfer to the said hatch, via a collection tray 43, of a packet 3 selected by the customer from a shelf 4, which shelf can therefore be considered as one of the above-mentioned supply compartments. In this collection tray 43 a flexible belt 44 is provided, attached between to opposite edges 45 and 46.

Figure 6:
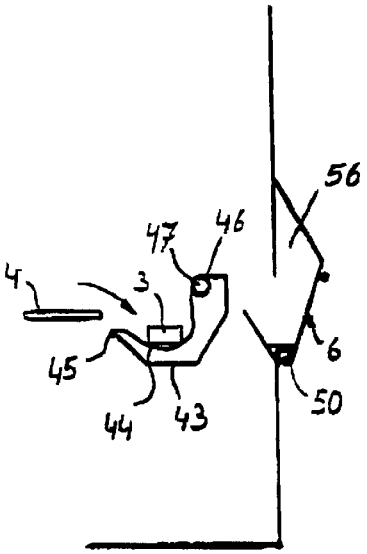
FIGS. 6 to 10 are very schematic representations of the operation of a particular embodiment of another important part of the distribution installation according to the invention.
Figure 7:
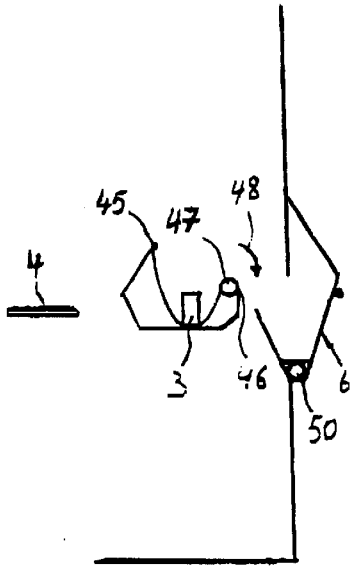

In a first position, as shown among others in FIG. 6, this belt 44 forms a hollow space in which the selected packet 3 arrives The collection tray 43 is rotatably-mounted on a shaft 47, in such a way that in a following step, as shown in FIG. 7, the packet 3 can undergo a swivel motion about the said shaft according to arrow 48.

Figure 8:
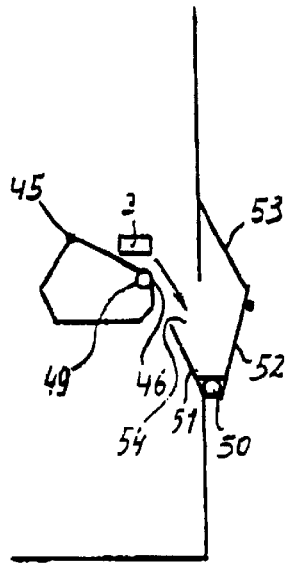
Figure 9:
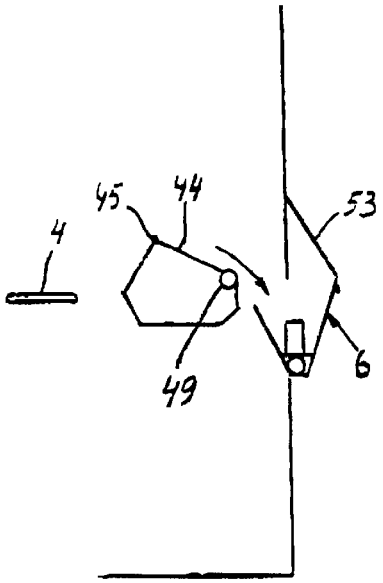

In a following step, as shown in FIG. 8, the flexible belt 44 is tightened to form a sloping surface between the two edges 45 and 46, which due to the fact that the edge 45 is higher than edge 46, slopes towards the dispensing hatch 6, with the result that the packet 3 concerned automatically slides into the dispensing hatch, as shown in FIG. 9.

The flexible belt 44 is preferably formed by a net or cloth that can be tightened in various ways, such as for example rolling up on a tube motor, as shown schematically by reference 49 on the figures, whose shaft coincides with the axis of rotation 47 of the collection tray 43 itself During these various movements, the access 56 to the dispensing hatch 6 for removing the packet 3 remains closed, as can be clearly seen in FIGS. 6 to 9, while it provides access to the collection tray 43.

Figure 10:
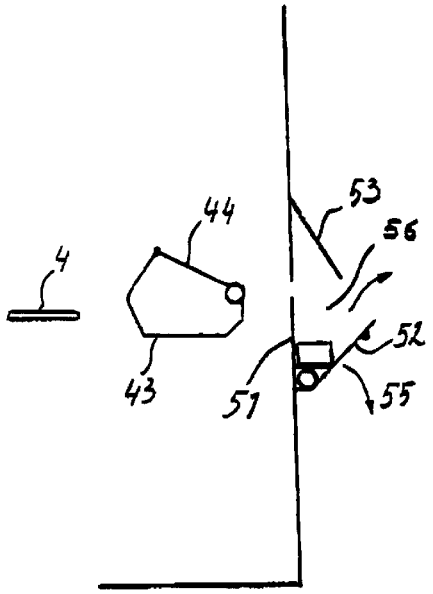

Once the packet has arrived in the dispensing hatch 6, the latter is opened for removing the dispensed packet 3, and the access 54 to the collection tray 43 is automatically closed, as clearly shown in FIG. 10. In this way, all access to the collection tray 43 and thus to the danger zone is prevented.

In this specific embodiment of the invention, the dispensing hatch consists of a rectangular recipient with a triangular cross-section which hinges about an axis 50 between two extreme positions, so that in one position, as shown in FIGS. 6 to 9, one of the longitudinal walls 51 is facing inwards and the other, opposite longitudinal wall 52 connects against a fixed flap 53 set in a slanting position on the outer wall of the distribution installation. In this way, the recipient of the hatch 6 is open on the side of the collection tray 43 and closed on the outside of the distribution installation By then making this recipient swivel about its axis 50 in the direction of arrow 55, the access 54 through the said wall 51 is fully closed off, and at the same time access 56 to the hatch or recipient 6 is made possible by the wall 52 swivelling outwards.

It should be mentioned that these improvements to the dispensing hatch do not necessarily have to be applied in combination with the above-mentioned conveyor belts 7 and 9 and/or the automatic cashier 5, but may also be provided in other distribution installations which may or may not already exist.

Since the various combined components of the automatic cashier, such as the receiver with the coin tester, the hoppers, the means for comparing the amount paid with the credit amount and the means for giving the command for repaying any positive balance are known in themselves, it is not considered necessary to describe them in detail.

The invention is not limited to the embodiments described above; within the scope of the invention, several modifications can be considered, among other things as regards the drive of the conveyor belt 7 as well as the transport means 9 which enable an ordered or selected packet to be brought from the exit of a specific compartment 8 to the dispersing hatch 6. For example, use can be made of a robot which by means of the operating device 1 can be moved along the various compartments 4. Thus the collection tray 43 can form part of such a robot or other transport means, and can be moved along the compartments 4.

I claim:

1. A distribution installation for packets comprising an operating device (1) and compartments (4) each having an exit (8), the compartments (4) located beside and above one another wherein the packets (3) to be selected can be arranged, and transport means (9) controlled by the operating device (1) being provided which enable a selected packet (3) to be transferred from the exit (8) of each of the compartments (4) to a dispensing hatch (6);

wherein in at least one compartment (4) a conveyor belt (7) is mounted which is controlled from the operating device (1) which enables the packets (3) accommodated in the one compartment (4) to be brought one by one to the exit (8) of the one compartment (4) as far as the transport means (9); and wherein said compartments (4) are separated from each other by intermediate compartments (12) in which is provided a drive mechanism (13) for the conveyor belt (7) against one side thereof.

2. The distribution installation according to claim 1, wherein the drive mechanism (13) comprises a cable transmission which can be moved in steps parallel to the conveyor belt (7), where between the said transmission and the conveyor belt (7) there is provision for an engagement dog (14) to be fixed on the conveyor belt (7) and permit the same motion to be imposed on the conveyor belt (7) as the motion of the said transmission (13), in a synchronous manner.

3. The distribution installation according to claim 1, wherein the conveyor belt (7) is removably mounted in the compartments (4).

4. The distribution installation according to claim 3, wherein the said drive mechanism (13) comprises a chain transmission which can be moved in steps parallel to the conveyor belt (7), where between the said transmission and the conveyor belt (7) there is provision for an engagement dog (14) to be fixed on the conveyor belt (7) and permit the same motion to be imposed on the conveyor belt as the motion of the said transmission (13), in a synchronous manner.

5. The distribution installation for packets according to claim 1, with the operating device equipped with an automatic cashier (5), where the automatic cashier (5) comprises a receiver (22) for inserted coins which works together with a coin tester which receiver (22) connects to a hopper subdivided into various compartments (32 to 35), and to a return hatch (19) for coins not accepted by the coin tester, wherein said coin tester is provided with means for guiding the accepted coins, type by type, to the various compartments (32 to 35) of the hopper, and further where control means (42) are provided which enable the total amount received in coins to be compared with a credit amount corresponding to the value of the packets ordered, and any remaining balance to be returned via the hopper to a hatch (19).

6. The distribution installation for packets according to claim 1, with an operating device (10 equipped with an automatic cashier (5), where the automatic cashier comprises a receiver (22) for inserted coins which works together with a coin tester, and a banknote reader, which receiver (22) connects to a hopper subdivided into various compartments (32 to 35) and to a return hatch (19) for coins not accepted by the coin tester, where said coin tester is provided with means for guiding the accepted coins, type by type, to the various compartments (32 to 35) of the hopper, and further where control means (42) are provided which enable the total amount received in coins and banknotes to be compared with a credit amount corresponding to the value of the packets ordered, and any remaining balance to be returned via the hopper to a hatch (19).

7. The distribution installation according to claim 6, wherein for each of the coins to be separated, a separate channel (36 to 39) is provided between the receiver (22) and a corresponding compartment (32 to 35) of the hopper.

8. The distribution installation for packets according to claim 1, with an operating device (1) and compartments (4) located beside and above one another in which the packets (3) to be selected can be arranged, in which transport means (9) controlled by the said device (1) are provided, which permit a selected packet to be transferred from one of the said compartments (4) to a dispensing hatch (6) and into a collection tray (43), wherein means are provided that enable a selected packet (3) to be transferred from the collection tray (43) in the dispensing hatch (6).

9. The distribution installation according to claim 8, wherein collection tray (43) is mounted so that it rotates about a shaft (47), in such a way that a packet (3) can be tipped out of the collection tray (43) into the dispensing hatch (6).

10. The distribution installation according to claim 8, wherein a flexible belt (44) is provided between two-opposite edges (45 and 46) of the collection tray (43), which in a first position defines a hollow space in the collection tray in which a selected packet arrives, and in a second position is tightened into a sloping surface between the two the said edges, in such a way that the corresponding packet (3) is automatically led into the dispensing hatch (6).

11. The distribution installation according to claim 8, wherein the dispensing hatch (6) can be set in two locked positions, where in the first position access is provided to the collection tray (43) and a packet (3) can be transferred from the latter to the dispensing hatch (6), while the access for taking out the packet is closed, and in a second position the access to the collection tray is closed, while the access for taking out the selected packet is opened.

* * * * *